US006409315B2

(12) United States Patent
Komuro

(10) Patent No.: US 6,409,315 B2
(45) **Date of Patent: *Jun. 25, 2002**

(54) SUBSTRATE FOR USE OF AN INK JET RECORDING HEAD, AN INK JET HEAD USING SUCH SUBSTRATE, A METHOD FOR DRIVING SUCH SUBSTRATE, AND AN JET HEAD CARTRIDGE, AND A LIQUID DISCHARGE APPARATUS

(75) Inventor: Hirokazu Komuro, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/901,661

(22) Filed: Jul. 28, 1997

(30) Foreign Application Priority Data

Jul. 31, 1996 (JP) ..... 8-202245

(51) Int. Cl.[7] ..... B41J 2/05
(52) U.S. Cl. ..... 347/58
(58) Field of Search ..... 347/56–59, 13, 347/42

(56) References Cited

U.S. PATENT DOCUMENTS

| | | | | | |
|---|---|---|---|---|---|
| 4,296,421 | A | * | 10/1981 | Hara et al. | 347/56 |
| 4,458,256 | A | * | 7/1984 | Shirato et al. | 347/58 |
| 4,719,478 | A | | 1/1988 | Tachihara et al. | |
| 4,720,716 | A | | 1/1988 | Ikeda et al. | |
| 4,841,312 | A | * | 6/1989 | Inoue et al. | 347/67 |
| 4,889,587 | A | | 12/1989 | Komuro | 156/643 |
| 4,936,952 | A | | 6/1990 | Komuro | 156/643 |
| 4,965,594 | A | | 10/1990 | Komuro | |
| 5,062,937 | A | | 11/1991 | Komuro | 204/192 |
| 5,140,345 | A | | 8/1992 | Komuro | |
| 5,159,353 | A | * | 10/1992 | Fasen et al. | 347/59 |
| 5,211,754 | A | | 5/1993 | Komuro | 118/300 |
| 5,633,665 | A | | 5/1997 | Komuro | 347/63 |
| 5,896,146 | A | * | 4/1999 | Murata et al. | 347/42 |

FOREIGN PATENT DOCUMENTS

| | | |
|---|---|---|
| DE | 3840412 A | 2/1990 |
| EP | 0532877 A | 3/1993 |
| JP | 54051837 | 4/1979 |
| JP | 57072867 | 5/1982 |
| JP | 62013367 | 1/1987 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A substrate for an ink jet recording head is provided with a plurality of heat generating resistors for discharging ink. The wiring for applying the electric power supplied from outside to the plurality of heat generating resistors is divided into plural numbers, and each of the plurally divided wiring is arranged to provide substantially the same wiring resistive value from each of electrode pads arranged together therewith for receiving the supply of electric power from outside to each of the heat generating resistors. With the structure thus arranged, it is made possible to make the difference smaller in the voltage drop at the time of driving all the heat generating resisters simultaneously and driving only one of them, respectively, as well as to perform stabilized discharging of liquid for the formation of recorded images in good condition.

21 Claims, 11 Drawing Sheets

SUBSTRATE FOR USE OF AN INK JET RECORDING HEAD, AN INK JET HEAD USING SUCH SUBSTRATE, A METHOD FOR DRIVING SUCH SUBSTRATE, AND AN JET HEAD CARTRIDGE, AND A LIQUID DISCHARGE APPARATUS

BACKGROUND OF THE INVENTION

1. Field of the Invention

The present invention relates to a substrate for use of the ink jet recording head of an ink jet recording apparatus that forms droplets by discharging liquid from orifices. The invention also relates to a head using such substrate.

2. Related Background Art

With respect to an ink jet recording head of the kind, an ink jet recording method, such as disclosed in the specification of Japanese Patent Laid-open Application No. 54-51837, is to cause thermal energy to act upon liquid for obtaining the power source for discharging liquid. This is the characteristic aspect of the method that differs from the other types of ink jet recording methods. In other words, the recording method disclosed in the specification of the Laid-Open Application described above, liquid is heated by the application of thermal energy and is caused to bubble. The force generated by the bubbles as they expand, causes droplets of liquid to be ejected out through orifices arranged at the leading end of the recording head unit. These ejected droplets impinge upon and adhere to a recording member and thereby record information on the recording medium.

A recording head which operates according to the recording method described above is generally provided with several orifices through which the liquid is discharged. Such head also includes as part of its structure a liquid discharging unit which contains heat activating portions, which connects with the orifice. In the heat activating portions thermal energy acts upon the liquid therein and causes droplets to be ejected through the orifices as described above. In the heat activating portions there are provided heat generating resistive layers that form electrothermal transducing elements which generate thermal energy; upper layers are provided to protect the heat generating resistive layers from ink. In addition lower layers are provided under the heat generating resistive layers to accumulate heat.

Also, in the specification of Japanese Patent Laid-open Application No. 57-72867, it has been proposed to incorporate an element for driving heat generating resistors on a substrate in order to minimize the numbers of required electrodes pads.

FIG. 12 is a plan view which shows an example of a conventional recording head substrate structure having electric power wiring arranged on a substrate together with heat generating resistors.

The example shown in FIG. 12 is a substrate used for a so-called edge shooter type ink jet recording head where liquid is discharged in the direction substantially in parallel with the heat generating surface of heat generating resistors (in the right-hand direction in FIG. 12).

In the example of FIG. 12, a heat generating resistive layer and electrode layer are provided on a silicone substrate. Then, by means of photolithographic technique, heat generating elements 71 and pads 73 for use of external fetch electrodes are formed. The size of each heat generating resistor 71 is 150 pm×30 $\mu$m. Eight resistors are provided at a pitch of 200 $\mu$m.

Subsequently, a protection layer is formed over the resistive and electrode layer. Then by means of a photolithographic technique, a common electrode 72 and electrode pads 73 are formed over the protective layer. Through holes 74 are provided in the common electrode 72 by making holes on a fetching unit of common electrode. The common electrode 72 and its electrode pads 73 are formed from an aluminum layer which is subjected to a photolithographic and etching technique to shape a common electrode 72 and an electrode pad 75 extending therefrom which is used for external fetching.

In the conventional recording head thus structured, each of the electrode pads 73 is connected via through holes and associated electrodes with one end of each heat generating resistor 71, while the other end of each heat generating resistor is connected with the common electrode 72 by way of associated ones of the through holes 74 for its shareable use. Thus, heat is generated when voltage is applied across the electrodes 73 and 75.

Each of the heat generating elements 71 is separated and covered by the walls (not shown) which are arranged between and over them to form associated liquid flow paths. Liquid supplied into the flow paths is discharged from each of the orifices (not shown) by the force of expanding bubbles which are formed in the liquid by heat generated by the associated heat generating elements.

A large number of electrode pads are required to receive electric power which is supplied from an external source through each of the electrode pads. In order to maximize printing speed, a large number of heat generating resistors should be provided. It frequently happens that many of these several heat generating resistors must be driven simultaneously. When driving many heat generating resistors at the same time, a large amount of current must be supplied to the ink jet head.

The driving of an ink jet head which uses thermal energy to discharge ink by bubbling is different from the driving of a thermal head. To produce a good bubbling effect, the electrical current pulses which are applied to the heat generating resistors should be as short as possible. Accordingly, the electrical current in these pulses is increased. Thus, even if the electric power wiring which transmits these current pulses is arranged with a low resistance, there is still a problem encountered in that the quality of printed images becomes inferior. This is due to impediments, such as the inability to effectuate normal bubbling or disabled bubbling, because the voltage which causes each current pulse is caused to drop by an amount which corresponds to the product of the difference that takes place in the electric current when only one heat generating resistor is driven and when many of them are driven at the same time. Also the resistive value of the electric power wires further contributes to this voltage drop because this inevitably results in a reduction of the voltage applied to the heat generating resistors when several of them are driven at a time.

The above described problems can be appreciated from the following description in which the specific numerical values are given. When thirty-two heat generating resistors, each having a resistance of 1 Ω, are driven together and arranged with the driving current of 0.2 A for each with a heat generating resistor, the total current flow is 32×0.2 or 6.4 A. When one of the resistors is driven along the total current flow is 1×0.2 or 0.2 A; so that the difference in total current flow when one of them is driven and when all of them at the same time, is 6.2 A.

When the driving voltage is set at 20 V, which is 1.3 times the bubbling voltage 15.3 V, the driving voltage 13.8 V, which is 20 V—such reduced voltage of 6.2 V, is lower than the bubbling voltage of 15.3 V. As a result, bubbling becomes impossible. In order to avoid this event, the applied voltage should be raised. However, if the applied voltage is raised, each of the heat generating resistors receives a greater voltage when each of them is driven individually. Therefore, the life of heat generating resistors is made shorter inevitably.

In convention practice each driving cycle is divided into several time increments and different groups of the heat generating resistors are driven in each time increment. Under the present circumstances, however, driving should be carried out at a high frequency in order to enhance the printing speed. Thus, the driving cycle should be as short as possible. However, the driving cycle duration is dependent primarily on the response capability of the driving element. It is difficult, because of the limited response capability of the driving element, to make the width of the driving pulse small and therefore only a limited number of driving pulses can be generated during each cycle. As a result, the number of time divisions cannot be increased any more.

Also, conceivably, it may be possible by varying the driving pulse components for the different voltage drops when different numbers of heat generating resistors are energized at the same time, by varying the width of the driving pulses so that wider pulses are produced when voltage drops become larger so that the amount of energy being used remains essentially constant. In this case, however, there is a need for the provision of a logic circuit that controls pulse width based on voltage drop to maintain a constant energy flow. This additional provision of a logic circuit leads to an inevitable increase in the manufacturing costs of the driving elements.

Also, it may be possible to make the wiring from a thick film by means of plating techniques or the like so that the resistance of the electric power wiring is made lower. In this case, however, a protection layer should be provided, because there is a possibility that the wires will otherwise come into contact with the ink. The provision of a protection layer on the thick film, however, causes its upper surface to be higher than the surface of the heat generating resistors. This, in turn, makes it difficult to form nozzle members downstream of the heat generating resistors, thus presenting another restriction in this respect. This is a particular problem because the recording head should be formed with very small ink flow channels so that ink droplets can be discharged with high precision. Specifically the nozzles should have a diameter in the order of 10 $\mu$m, while the plated thick film wiring is also in the order of 10 $\mu$m. In such case the problem is particularly conspicuous.

In order to reduce the resistance of the electric power wiring, it is generally necessary to make the electric power wires thicker. In such case the size of the substrate should be made larger accordingly. The manufacturing costs of the substrate increases significantly when a large number of heat generating elements are incorporated into the substrate. This is because the heat generating elements represent a large percentage of the cost of manufacturing the printing heads. In order to avoid this large cost, it may be conceivable to increase the number of pads which receive current from external fetch electrodes and thereby reduce the electrical resistance of an external wiring plate. However, increasing the number of pads not only reduces the reliability, it also requires the use of a larger substrate.

SUMMARY OF THE INVENTION

In order to solve the problems described above, the present invention provides in a substrate for an ink jet recording head, a plurality of heat generating resistors for discharging ink, as well as novel wiring arrangements for applying externally supplied electric power. According to these novel arrangements the heat generating resistors are divided into a plurality of groups with associated wiring. The wiring for each group has substantially the same wiring resistive value from its respective electrode pads arranged together therewith for receiving the supply of electric power from outside to its respective heat generating resistors.

In addition, a driving element may be incorporated within the substrate for driving heat generating resistors.

Further, the wiring for the plural groups may be connected together in the vicinity of the electrode pads.

Also, the electrode pads may be arranged on the edge portion of the substrate so that they are arranged in a direction different from the arrangement direction of the heat generating resistors.

According to another aspect, the present invention provides a novel method for driving a substrate structured as described above. This novel method is characterized in that time divisional driving is performed for the respective heat generating resistors.

According to a still further aspect the present invention provides a novel ink jet head which incorporates a substrate which is structured as described above.

According to yet another aspect of the invention there is provided a novel ink jet head cartridge which incorporates the ink jet head as described above.

In another aspect of the invention there is provided a novel liquid discharge apparatus having an ink jet head as described above, together with means for supplying driving signals in order to discharge liquid from such ink jet head.

In accordance with the present invention as described above, it is possible to arrange the resistive values of the wiring to be almost the same from the electrode pads provided together with the heat generating resistors to receive the supply of electric power from outside up to each of the heat generating resistors, thus making the amount of voltage drop smaller for each of the heat generating resistors when all of them are driven and when each of them is driven, respectively. Then, when time divisional driving is used to reduce the number of heat generating resistors being driven simultaneously, it becomes possible to reduce the number of divided groups within the substrate, thus producing more favorable effect. Particularly, it is preferable to perform separate driving for each block of the divided wiring.

Also, by incorporating the driving element on the substrate, it is possible to arrange the electric power wiring freely on the driving element. This facilitates both the division of the wiring and the adjustment of the wiring resistive values.

Here, in particular, the numbering of fetching connections can be reduced by dividing the electric power wiring into groups within the substrate and by connecting each group with associated electrode pads for external fetching.

Also, for an ink jet head which discharges ink vertically from the heat generating resistors, the present invention provides an advantage which is obtainable by arranging the pads for external fetching on the edge portions perpendicular to the arrangement direction of the heat generating resistors. In this way, the pad area can be made smaller. Also, it becomes easier to arrange each of the nozzle arrays.

In the cases described above, the electric power wiring can be divided for its effective arrangement to make the size of substrate smaller, leading to the significant reduction of costs of manufacture.

DETAILED DESCRIPTION OF THE PREFERRED EMBODIMENTS

Now, with reference to the accompanying drawings, the following description will be made of one embodiment in accordance with the present invention.

Figure 1:
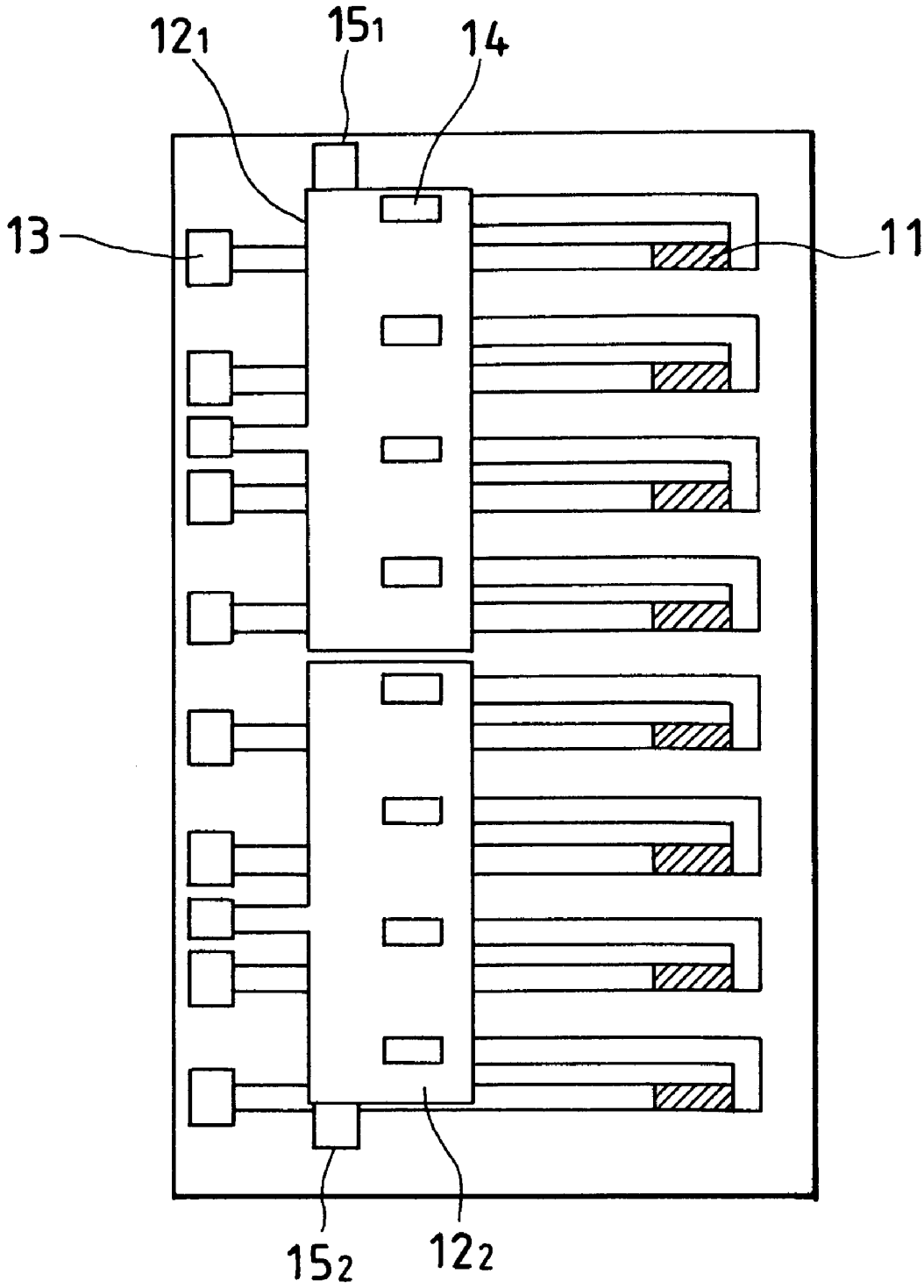
FIG. 1 is a plan view which shows a substrate in accordance with a first embodiment of the present invention.

FIG. 1 is a plan view which shows a substrate for use of an ink jet recording head in accordance with a first embodiment of the present invention.

Figure 12:
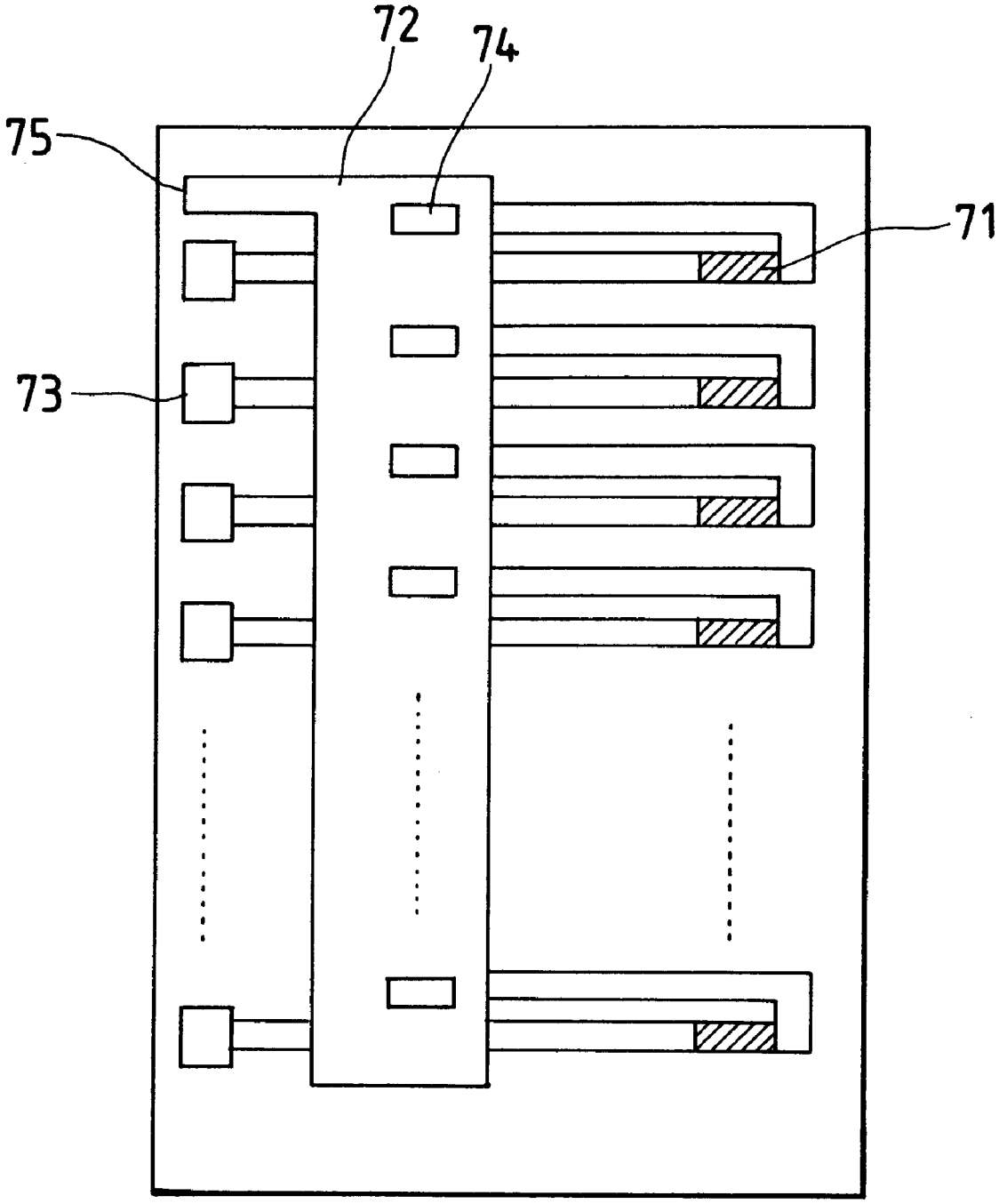
FIG. 12 is a plan view which shows the conventional substrate.

The present embodiment is a substrate for use of the so-called edge shooter type ink jet recording head that discharges liquid in the direction substantially in parallel with the heat generating surface of the heat generating resistors (in the right-hand direction in FIG. 1) as in the conventional example shown in FIG. 12.

A reference numeral 11 designates a heat generating resistor; $\mathbf{12}_1$, and $\mathbf{12}_2$ common electrodes (positive electrodes); 13, a pad for use of external fetch electrode for the heat generating element 11; 14, a through hole that connects the electrode of the heat generating resistor and the common electrode; and $\mathbf{15}_1$ and $\mathbf{15}_2$, pads for use of an external fetch electrode for the common electrodes $\mathbf{12}_1$, and $\mathbf{12}_2$, respectively.

The following is a specific description of a method for the manufacture of the present embodiment.

The substrate of the present embodiment is a substrate for use of an ink jet recording head whose discharging direction is in parallel with the heat generating resistors.

On a silicon substrate, a heat generating resistive layer and electrode layer are produced, and then, by means of photolithographic technique, the heat generating elements 11 and the pads 13 for use of external fetch electrodes are formed. The size of each heat generating resistor 11 is 150 $\mu$m×30 $\mu$m. Eight resistors are produced at a pitch of 200 $\mu$m.

Subsequently, a protection layer is formed. Then by means of photolithographic technique, the electrode pads 13 are formed, and also, through holes 14 are provided by making holes on the fetching units $\mathbf{15}_1$ and $\mathbf{15}_2$ of the common electrodes $\mathbf{12}_1$ and $\mathbf{12}_2$. Thereafter, an aluminum layer is formed to provide the common electrodes. Then, using a photolithographic technique, the common electrodes $\mathbf{12}_1$ and $\mathbf{12}_2$ and the electrode pads $\mathbf{15}_1$ and $\mathbf{15}_2$ for use of external fetching for the common electrodes $\mathbf{12}_1$ and $\mathbf{12}_2$ are formed.

In accordance with the previously described conventional example, each of the electrode pads 13 is connected with one end of each heat generating resistor 11, while the other end of each heat generating resistor is connected with one of the common electrodes $\mathbf{12}_1$, and $\mathbf{12}_2$ by way of the through holes 14 for its shareable use. The electrode pads 13 are grounded. Thus, heat is generated when voltage is applied across each of the electrodes 13 and 15.

Each of the heat generating elements 11 is separated and covered by the flow path walls (not shown) arranged between them. Liquid supplied into the space formed by such flow path walls is discharged from each of the orifices (not shown) by the creation of bubbles brought about by heat generated by each of the heat generating elements.

The structure and the steps of manufacture of the present embodiment are generally the same as those described in conjunction with the conventional example shown in FIG. 12. However, the present embodiment differs from the conventional one in that common electrodes $\mathbf{12}_1$ and $\mathbf{12}_2$ are provided, each of which has associated therewith four heat generating resistors 11 respectively, and each of which has an associated one of the two pads $\mathbf{15}_1$ and $\mathbf{15}_2$ which are arranged for use of each of external fetch electrodes with respect to the associated common electrodes $\mathbf{12}_1$, and $\mathbf{12}_2$.

Now, hereunder, as compared with the conventional example shown in FIG. 12, the features of the present embodiment which uses plural common electrodes will be described with reference to specific numerical values.

At first, a specific description will be made of the conventional example shown in FIG. 12, which serves as a comparative example.

(Comparative Example 1)

The common electrode 72 shown in FIG. 12 has a dimension of 100 $\mu$m×3,200 $\mu$m, with its sheet resistive value being 50 mΩ, and its resistive value being 0.05×3, 200/100=1.6 Ω.

The bubbling voltage of the heat generating resistor 71 is 8 V. The driving voltage is set at 10 V, which is 1.25 times the bubbling voltage. The driving current is 0.2 A. As mentioned previously, there are eight heat generating resistors 71 in this example.

The difference between the total driving current when all of the heat generating resistors 71 are driven simultaneously and when only one heat generating resistor 71 is driven is calculated as follows: 0.2 A×8−0.2 A=1.4 A.

The difference between the voltage values (the amount of voltage drop) when all the heat generating resistors 71 are driven and when only one heat generating resistor 71 is driven is calculated as follows: 1.4 A×1.6Ω=2.2 V. Therefore, the voltage drop across the common electrode 72 becomes 7.8 V when all the heat generating resistors are driven. This effectively reduces the voltage drop across the heat generating resistor to 2.2 V, thus making it impossible for the heat generating resistors to generate bubbles.

(Embodiment 1)

Each of the common electrodes $\mathbf{12}_1$, and $\mathbf{12}_2$ shown in FIG. 1 has a dimension of 100 $\mu$m×1,600 $\mu$m, with the sheet resistive value being 50 mΩ, and the resistive value being 0.05×1,600/100=0.8Ω.

The difference between the driving currents when all the heat generating resistors 11 are driven and when only one heat generating resistor 11 is driven is 0.2 A×8−0.2 A=1.4 A. However, since the common electrodes of the present embodiment are divided into two, that is, common electrodes $\mathbf{12}_1$, and $\mathbf{12}_2$, the actual value of current passing through the common electrodes $\mathbf{12}_1$, and $\mathbf{12}_2$ is divided, and the difference in the actual driving current is the associated common electrode which is 0.2 A×4−0.2 A=0.6 A.

Therefore, the difference between the voltage values (the amount of voltage drop across each of the electrodes $\mathbf{12}_1$, and $\mathbf{12}_2$) when all the heat generating resistors 11 are driven and when only one heat generating resistor 11 is driven is 0.6 A×0.8 Ω=0.48 V; and the voltage value across each heat generating resistor 11 becomes 9.52 V when all the heat generating resistors are driven. Thus no problem is encountered in the bubbling operation.

As described above, the common electrodes of the substrate of the present embodiment are divided among different groups of heat generating resistors to reduce their resistive effect and at the same time, to reduce the difference between the actual driving currents when different numbers of heat generating resistors are driven. As a result, bubbling is effectuated without any problem even when all the heat generating elements are driven at the same time. Hence, even an ink jet recording head that uses a higher grade substrate can perform recording in a stable manner without requiring a larger substrate. Such ink jet recording head can therefore be manufactured at lower costs.

(Embodiment 2)

The following is a description of another embodiment in accordance with the present invention.

Figure 2:
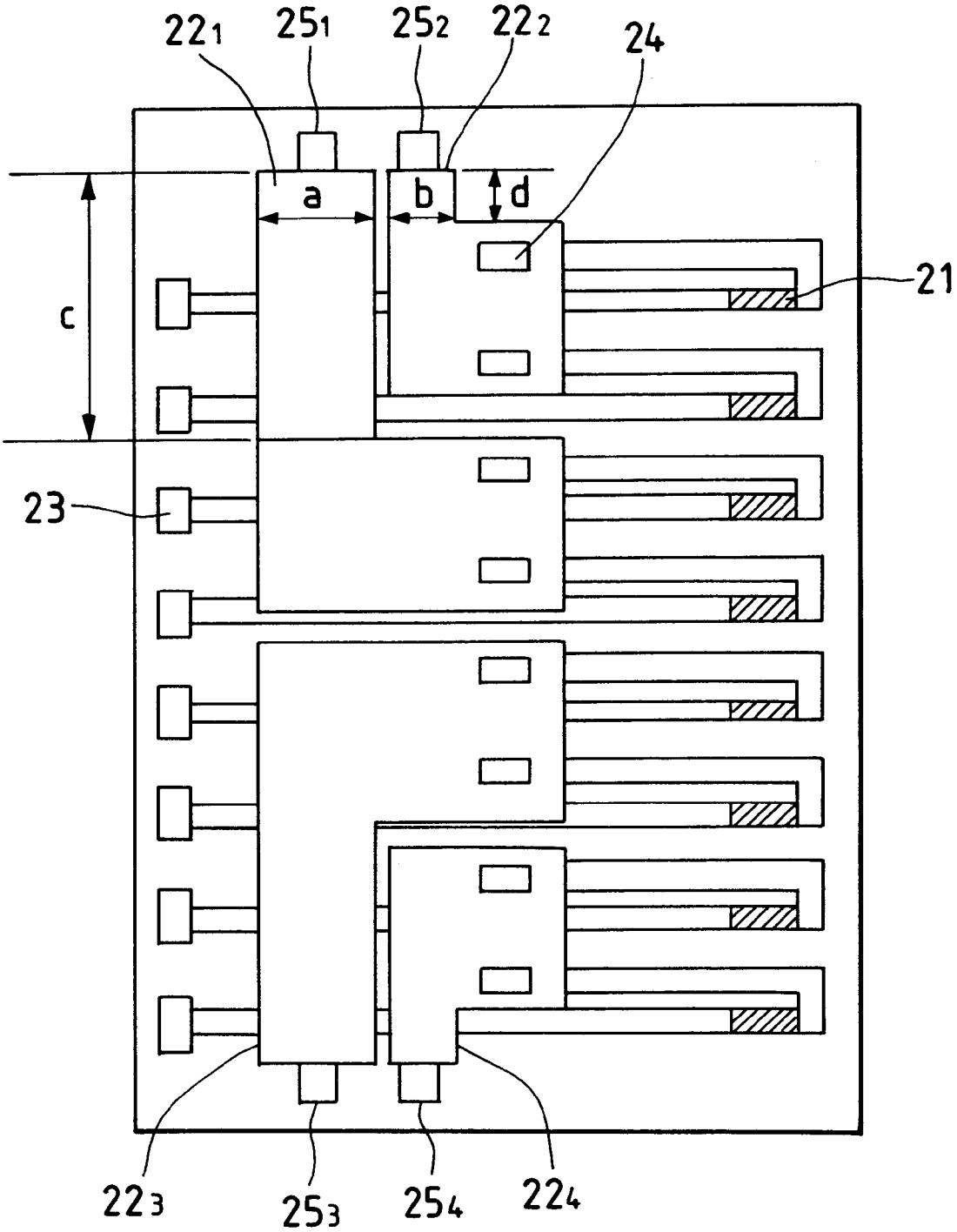
FIG. 2 is a plan view which shows a substrate in accordance with a second embodiment of the present invention.

FIG. 2 is a view which shows the structure of a second embodiment in accordance with the present invention. Heat generating resistors 21, electrode pads 23 and through holes 24 are provided and are the same as the heat generating resistors 11, electrode pads 13, and through holes 14 shown in FIG. 1. However, in accordance with the present embodiment, four common electrodes $\mathbf{22}_1$ to $\mathbf{22}_4$ are provided, each of which correspond to two of the heat generating resistors 21. Then, pads $\mathbf{25}_1$, to $\mathbf{25}_4$ are arranged for use of external fetch electrodes accordingly.

As shown in FIG. 2, each of the common electrodes $\mathbf{22}_1$, to $\mathbf{22}_4$ are arranged symmetrically to the center of the arrangement direction of the heat generating resistors 21 (i.e. symmetrically to a line that divides FIG. 2 into two in a top to bottom direction). The resistive values of the common electrodes $\mathbf{21}_1$ and $\mathbf{22}_1$, are determined by the lengths a and c and the resistor values of the common electrodes $\mathbf{22}_2$ and $\mathbf{22}_4$ are determined by the lengths b and d. The dimensions of the lengths a to d are: a=100 μm; b=25 μm; c=400 μm; and d=100 μm. The sheet resistive value of the electrode material is 50 mΩ. The resistive value of the common electrodes $\mathbf{22}_1$, and $\mathbf{22}_3$, which is determined by the lengths a and c, is 0.05×400/100=0.2 Ω. The resistive value of the common electrodes $\mathbf{22}_2$ and $\mathbf{22}_4$, which is determined by the lengths b and d, is 0.05×100/25=0.2 Ω.

In accordance with the present embodiment, the common electrodes are divided still more. As compared with the first embodiment, it is possible to attempt the further reduction of resistance of the common electrodes. The amount of voltage drop when all the heat generating resistors 21 are driven is (0.2 A×8/4−0.2 A×1)×0.2=0.04 V. As a result, there is almost no problem in this respect.

Also, by selecting the dimensions that determine the resistive values as described above, it is possible to make the resistive value of each of the supply electrodes $\mathbf{22}_1$–$\mathbf{22}_4$ more uniform, even if the edge surfaces for the formation of electrode pads 23 and electrode pads 25 are different. As a result, this voltage charge when different numbers of heat generating resistors are energized becomes smaller and the ink discharging characteristics of the recording head become superior.

(Embodiment 3)

Now, the description will be made of another embodiment in accordance with the present invention.

Figure 3:
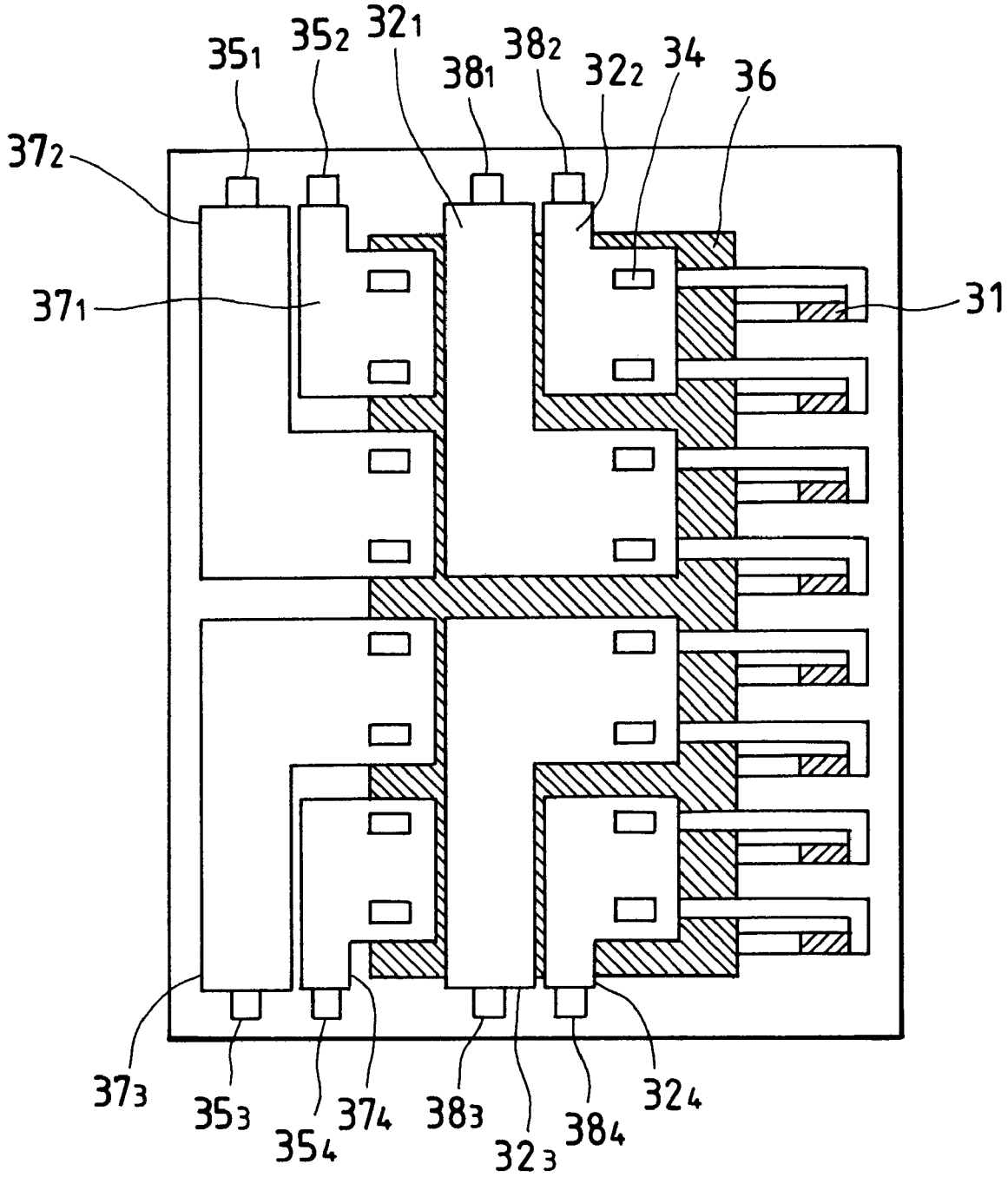
FIG. 3 is a plan view which shows a substrate in accordance with a third embodiment of the present invention.

FIG. 3 is a view which shows the structure of a third embodiment in accordance with the present invention. The arrangement and configurational dimensions of the heat generating resistors of the present embodiment are the same as those of the heat generating resistors shown in FIG. 1.

In accordance with the present embodiment, a driving element 36 is incorporated by means of NMOS processing on the substrate of the heat generating resistors 31 in order to drive them.

The driving element 36 is arranged to drive the heat generating resistors 31 in response to externally supplied data signals which are applied to input terminals (not shown), and also to clock signals and to signals that indicate the pulse width, among others. For the driving element 36, positive voltage and grounding voltage of the driving voltage are provided through the common electrodes in order to drive the heat generating resistors 31. With the structure thus arranged, the electrode pads, which in prior embodiments were arranged individually for each of the heat generating resistors, are eliminated, thus reducing the number of electrode pads.

For the driving element 36, a grounding voltage is supplied through the electrode pads $\mathbf{35}_1$, to $\mathbf{35}_4$, common electrodes $\mathbf{37}_1$, to $\mathbf{37}_4$, and through holes 34. A positive voltage is likewise supplied through the electrode pads $\mathbf{38}_1$, to $\mathbf{38}_4$, common electrodes $\mathbf{32}_1$, to $\mathbf{32}_4$, and through holes 34. The configurational dimensions of the common electrodes $\mathbf{37}_1$, to $\mathbf{37}_4$, and $\mathbf{32}_1$, to $\mathbf{32}_4$ are arranged so that the resistive values thereof are made equal to those of the common electrodes $\mathbf{25}_1$ to $\mathbf{25}_4$ described in conjunction with the embodiment 2. Also, the electrode pads $\mathbf{35}_1$, to $\mathbf{35}_4$, and $\mathbf{38}_1$, to $\mathbf{38}_4$, which are arranged together with each of the common electrodes $\mathbf{37}_1$, to $\mathbf{37}_4$, and $\mathbf{32}_1$ to $\mathbf{32}_4$, are arranged on the edge surface substantially perpendicular to the arrangement direction of the heat generating resistors 31.

In accordance with the present embodiment structured as described above, the amount of voltage drop should be taken into account on two aspects when a voltage is applied to all the heat generating resistors 31 at the time of driving. This is because the common electrodes receive both the positive voltage and the grounding voltage. Therefore, as compared with the first and second embodiments, there are provided two bases for voltage reduction and the amount of voltage reduction is less. However, since there are now four common electrodes, the amount of actual voltage drop is (0.2 A×8/4−0.2 A )×0.2×2=0.08 V.

Hence, there is no problem in carrying out bubbling; and liquid discharging is carried out with high precision.

(Embodiment 4)

Now, the description will be made of another embodiment in accordance with the present invention.

Figure 4:
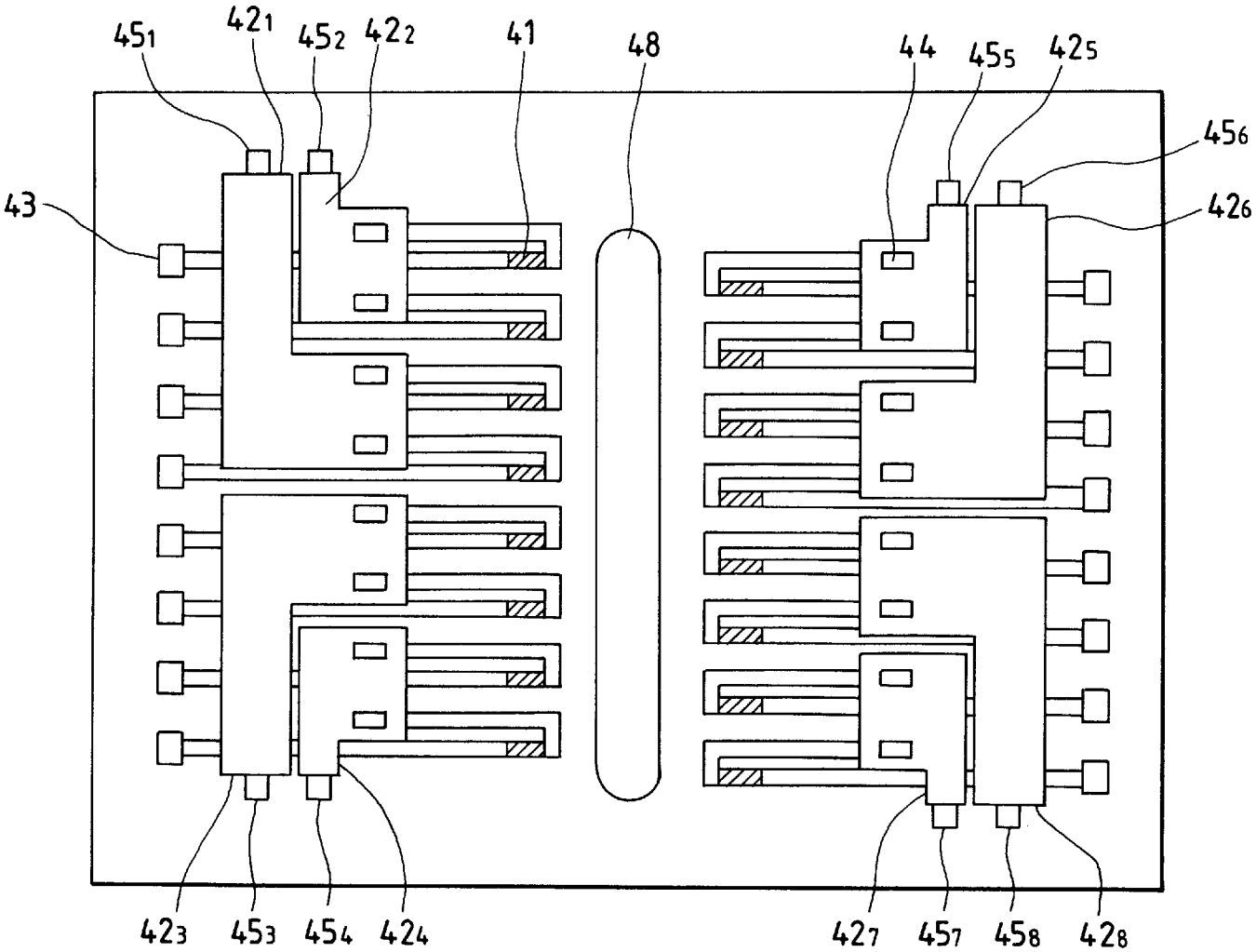
FIG. 4 is a plan view which shows a substrate in accordance with a fourth embodiment of the present invention.

FIG. 4 is a view which shows the structure of a fourth embodiment in accordance with the present invention. Whereas each of the embodiments shown in FIG. 1 to FIG. 3 is a substrate for an edge shooter type ink jet recording head where liquid is discharged in the direction substantially in parallel with the heat generating surface of the heat generating resistors, the present embodiment is a substrate for a side shooter type ink jet recording head where liquid is discharged in a direction substantially perpendicular to the heat generating surface of the heat generating resistors.

The heat generating resistors 41 of the present embodiment are arranged in sets; each of which comprises two heat generating resistors, each of which has the same arrangement and configurational dimensions as the heat generating resistor 11 of the embodiment 1. Each set of heat generating resistors 41 is arranged to face another set in a staggered fashion as shown in FIG. 4. Between each of the sets, an ink supply port 48 is provided. The port 48 is opened by means of blast processing.

For the set of heat generating resistors 41 positioned on the left-hand side in FIG. 4, a grounding voltage is provided through electrode pads $\mathbf{45}_1$, to $\mathbf{45}_4$, common electrodes 42, to $\mathbf{42}_4$, and through holes 44. For the set of each heat generating resistors 41 positioned on the right-hand side in FIG. 4, positive voltages are provided through electrode pads $\mathbf{45}_5$ to $\mathbf{45}_8$ common electrodes $\mathbf{42}_5$ to $\mathbf{42}_8$, and through holes 44. Also, individual driving of each heat generating resistor 41 is performed via electrode pads 43 arranged in connection with associated ones of each of the heat generating resistors 41 as in the case of the first and second embodiments.

The dimensions of the common electrodes $\mathbf{42}_1$ to $\mathbf{42}_4$, and $\mathbf{42}_5$ to $\mathbf{42}_8$ are arranged so that the resistive values thereof are made equal to those of the common electrodes $\mathbf{25}_1$, to $\mathbf{25}_4$ described in conjunction with the embodiment 2, respectively. Also, the electrode pads $\mathbf{42}_1$ to $\mathbf{42}_4$, and $\mathbf{42}_5$ to $\mathbf{42}_8$, which are arranged together with each of the common electrodes $\mathbf{42}_1$ to $\mathbf{42}_4$, and $\mathbf{42}_5$, to $\mathbf{42}_8$, are arranged on the edge surfaces of the common electrodes substantially perpendicular to the arrangement direction of the heat generating resistors 41.

In accordance with the present embodiment as described above, ink, which is supplied at the ink supply port 48 flows through liquid flow passages which are formed by the walls that surround each of the heat generating resistors and discharge ports. The ink flows over each of the heat generating resistors 41 through the respective flow paths; and then, by means of bubbling, the ink is discharged vertically above the surface of the substrate shown in FIG. 4.

The structure of the common electrodes of the present embodiment is the same as that of embodiment 2 described above. The voltage drop across the common electrodes is also the same as in embodiment 2. Bubbling is therefore carried out without any problem; and results in good discharge of the liquid ink.

(Embodiment 5)

Another embodiment in accordance with the present invention is described below.

Figure 5:
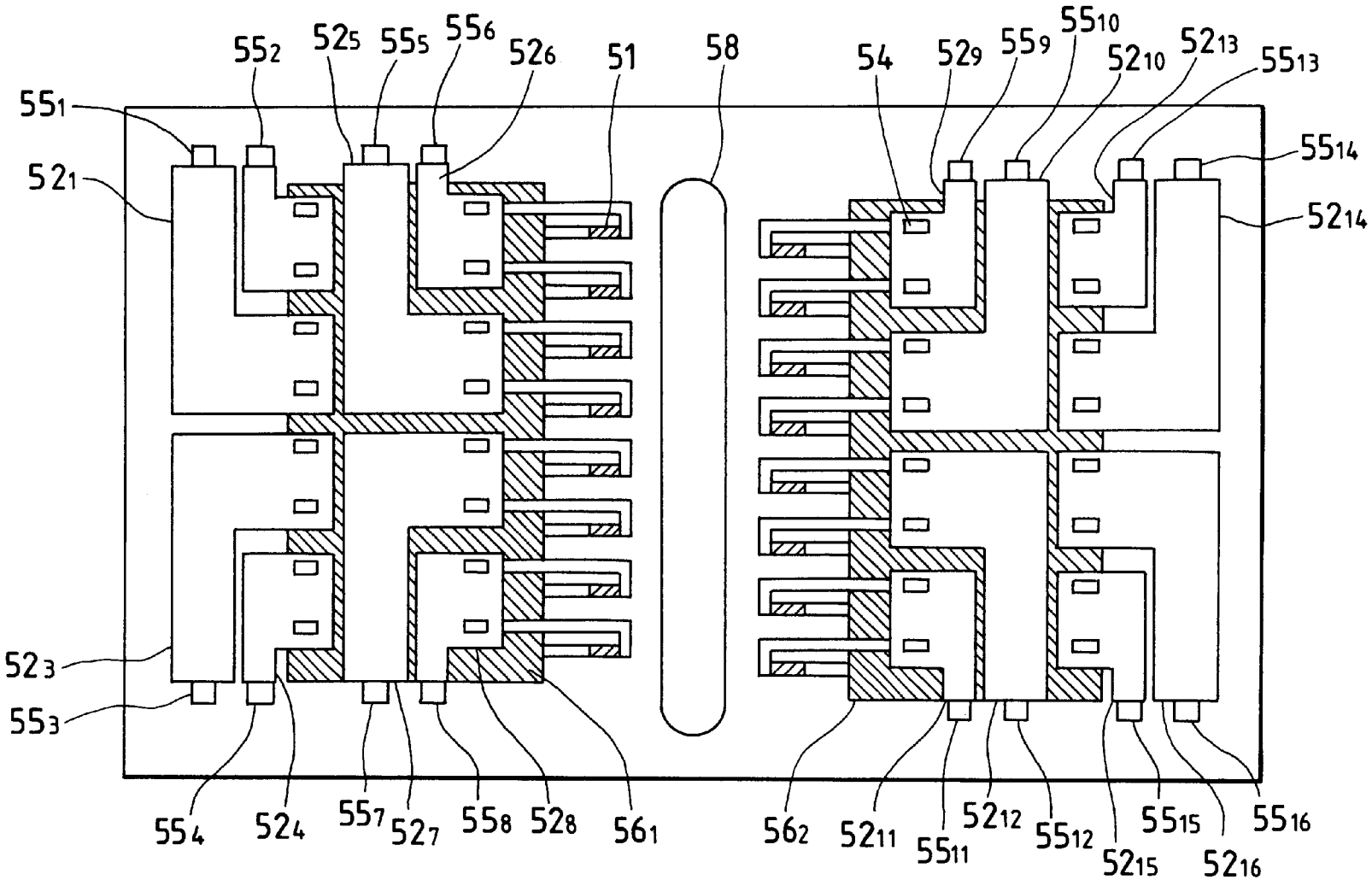
FIG. 5 is a plan view which shows a substrate in accordance with a fifth embodiment of the present invention.

FIG. 5 is a view which shows the structure of a fifth embodiment in accordance with the present invention. The present embodiment is a substrate for use of a side shooter type ink jet recording head where liquid is discharged in a direction substantially perpendicular to the heat generating surface of the heat generating resistors as in the fourth embodiment shown in FIG. 4.

Heat generating resistors 51 are arranged in the present embodiment in sets of two, each of which has the same arrangement and configurational dimensions as those of the heat generating resistors 11 of embodiment 1. Each set that comprises a plurality of the heat generating resistors 51 is arranged to face a corresponding set in a staggered fashion. Between each of the sets, an ink supply port 58 is provided. This port is opened by means of blast processing.

In the present embodiment, driving elements $\mathbf{56}_1$, and $\mathbf{56}_2$ are provided to drive the heat generating resistors 51. The driving elements are incorporated on the substrate by means of NMOS processing as in the embodiment 3 shown in FIG. 3. As described above, the heat generating resistors 51 are arranged in staggered fashion in accordance with the present embodiment. The heat generating resistors 51 on the left-hand side in FIG. 5 are provided with grounding voltage through electrode pads $\mathbf{55}_1$, to $\mathbf{55}_4$, common electrodes $\mathbf{52}_1$, to $\mathbf{52}_4$, and through holes 54. Positive voltages are provided through electrode pads $\mathbf{55}_5$ to $\mathbf{55}_8$, common electrodes $\mathbf{52}_5$, to $\mathbf{52}_8$, and through holes 54. The heat generating resistors 51 on the right-hand side in FIG. 5 are provided with positive voltages through electrode pads $\mathbf{55}_9$ to $\mathbf{55}_{12}$, and common electrodes $\mathbf{52}_9$ to $\mathbf{52}_{12}$. Grounding voltage is provided for the right-hand side heat generating resistor through electrode pads $\mathbf{55}_{13}$ to $\mathbf{55}_{16}$ and common electrodes $\mathbf{52}_{13}$, to $\mathbf{52}_{16}$.

The dimensions of the common electrodes $\mathbf{52}_1$, to $\mathbf{52}_{16}$ are arranged such with their resistive values are equal to the resistive values of the common electrodes $\mathbf{25}_1$ to $\mathbf{25}_4$ in embodiment 2. Also, the electrode pads $\mathbf{55}_1$, to $\mathbf{55}_{16}$ which are arranged together with each of the common electrodes $\mathbf{52}_1$ to $\mathbf{52}_{16}$, are arranged along edge surfaces which are substantially perpendicular to the arrangement direction of the heat generating resistors 51.

In accordance with the present embodiment, it is possible to carry out bubbling with precision when the heat generating resistors are driven at the same time as in each of the embodiments described above.

(Embodiment 6)

A still further embodiment in accordance with the present invention is described below.

Figure 6:
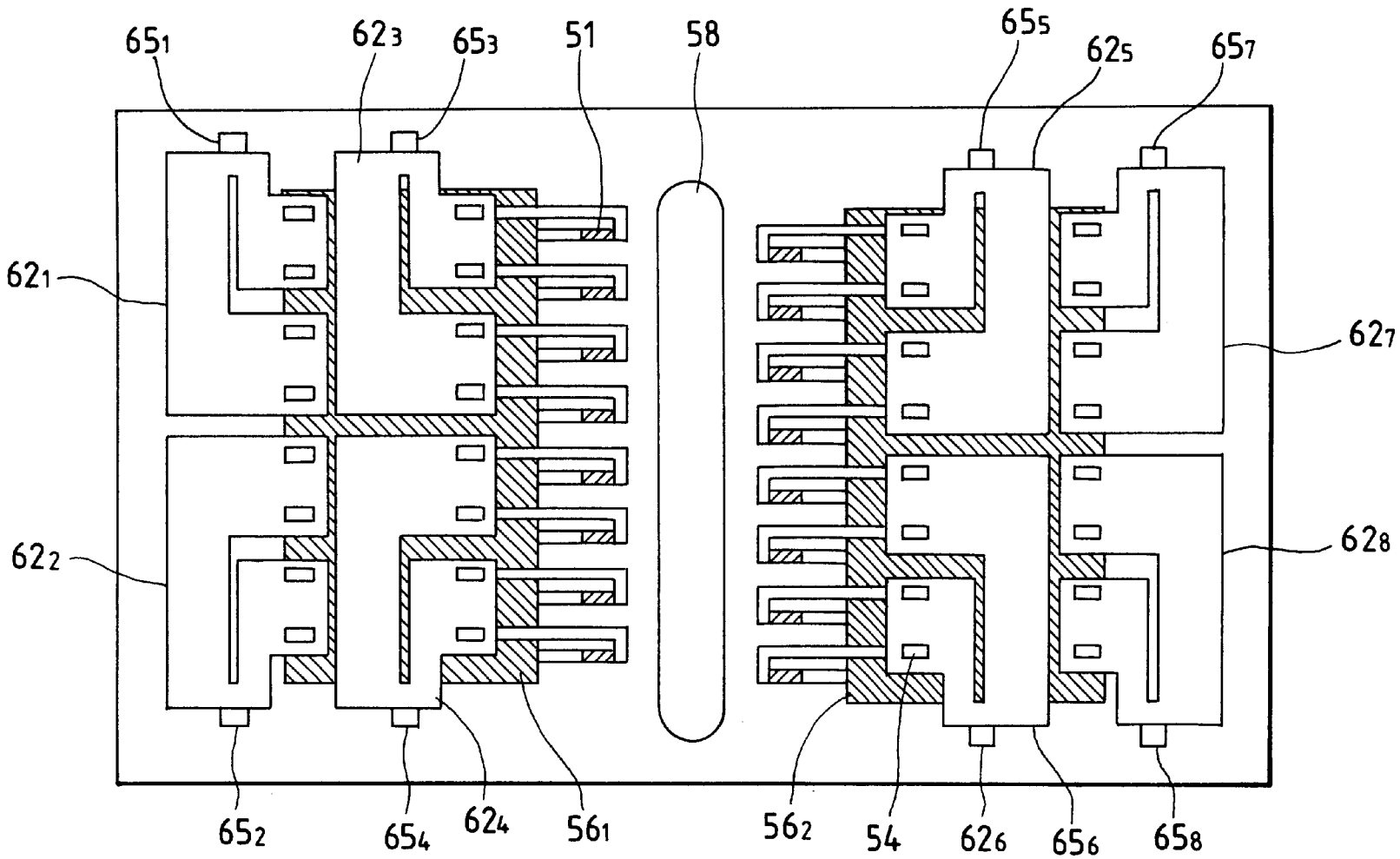
FIG. 6 is a plan view which shows a substrate in accordance with a sixth embodiment of the present invention.

FIG. 6 shows a substrate which comprises a sixth embodiment of the present invention. In the present embodiment electrode pads for external fetching and for the common electrodes are reduced as in the fifth embodiment shown in FIG. 5. Common electrodes $\mathbf{62}_1$ to $\mathbf{62}_8$, are configured so that each couples two common electrodes corresponding to the common electrodes $\mathbf{52}_1$, and $\mathbf{52}_2$, $\mathbf{52}_3$ and $\mathbf{52}_4$, $\mathbf{52}_5$ and $\mathbf{52}_6$, $\mathbf{52}_7$ and $\mathbf{52}_8$, $\mathbf{52}_9$ and $\mathbf{52}_{10}$, $\mathbf{52}_{11}$ and $\mathbf{52}_{12}$, $\mathbf{52}_{13}$ and $\mathbf{52}_{14}$, $\mathbf{52}_{15}$ and $\mathbf{52}_{16}$ shown in FIG. 5, respectively. In addition, electrode pads $\mathbf{65}_1$, to $\mathbf{65}_8$, are arranged together with corresponding common electrodes $\mathbf{62}_1$ to $\mathbf{62}_8$. The remaining structure of the present embodiment is the same as in the fifth embodiment. Therefore, the same reference characters from FIG. 5 are used for the corresponding elements in FIG. 6. These elements are described above; and a further description thereof is omitted.

Each of the common electrodes $\mathbf{62}_1$ to $\mathbf{62}_8$, is configured to be in the form that each group of two electrodes is coupled in the vicinity of the electrode pads $\mathbf{65}_1$, to $\mathbf{65}_8$. Because of this arrangement, the amount of voltage drop across the electrodes is almost equal to that which occurs across the corresponding electrodes in the fifth embodiment. Moreover, the number of the electrode pads needed for external fetching for the common electrodes is reduced by 50%.

Also, in accordance with the present embodiment, the electrode pads $\mathbf{65}_1$, to $\mathbf{65}_8$ for energizing the driving elements are arranged along the edge surfaces in a direction which is perpendicular to the arrangement direction of the heat generating resistors 61. As a result, the electrode pads are formed along two parallel sides. Terminals (not shown) are arranged perpendicular to these sides and receive data signals, clock signals, and signals that indicate the pulse width, among some others. In this way, the pads formed on the substrate become bidirectional. This makes it possible to reduce the size of the substrate.

Several substrates like that shown in FIG. 6 can also be coupled side by side. With such arrangement, it is possible to fabricate substrates for color recording where a pair of supply ports for ink of different colors, such as magenta, cyan, yellow, and black, for example, may be provided. In this case, too, the amount of voltage drop across the common conductors can be minimized as described above.

Further, a driving method, may be used in which the two heat generating resistors connected to each common electrode are energized at different times during the driving cycle. When driving is carried out, the same amount of driving current flows to each of the common electrodes when all the heat generating resistors are driven as when only one of them is driven. Accordingly, the voltage drop across the common electrodes is the same when all the heat generating resistors are driven as when only one of them is driven.

As a result, it is possible to design a substrate without giving any consideration to possible differences in voltage drop across the common electrodes. Also, the capability for bubbling is made constant and is independent of the number of heat generating resistors to be driven. In other words, the ink discharging performance becomes uniform, hence making it possible to provide an ink jet recording head having stabilized printing performance.

(Ink Jet Head)

An ink jet head which incorporates the above described ink jet substrates is described below.

Figure 7:
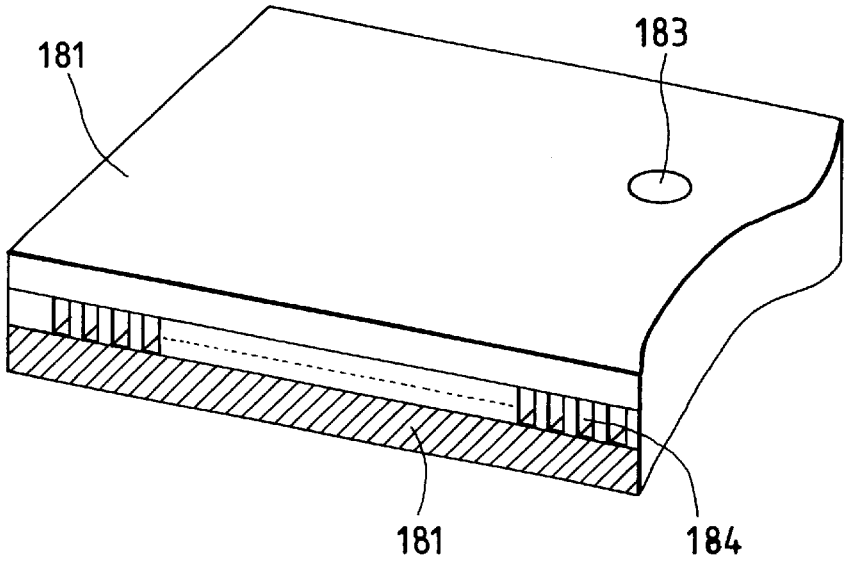
FIG. 7 is a perspective view which shows the structure of an edge shooter type ink jet head using the substrate in accordance with either one of the first embodiment to the third embodiment.

FIG. 7 is a perspective view which shows an edge shooter type ink jet head which may incorporate any of the substrates of the first to third embodiments shown in FIG. 1 to FIG. 3.

FIG. 7 shows a substrate 181 onto which photosensitive resin is laminated. The substrate may be constructed according to any of the first to third embodiments. Flow path walls are formed by means of known photolithographic and etching technique. Thereafter, a cover 182 having an ink supply port 183 is fixed onto the substrate. The assembly is then cut to form discharge ports 184, discharge nozzles, and a liquid chamber at the same time.

Figure 8:
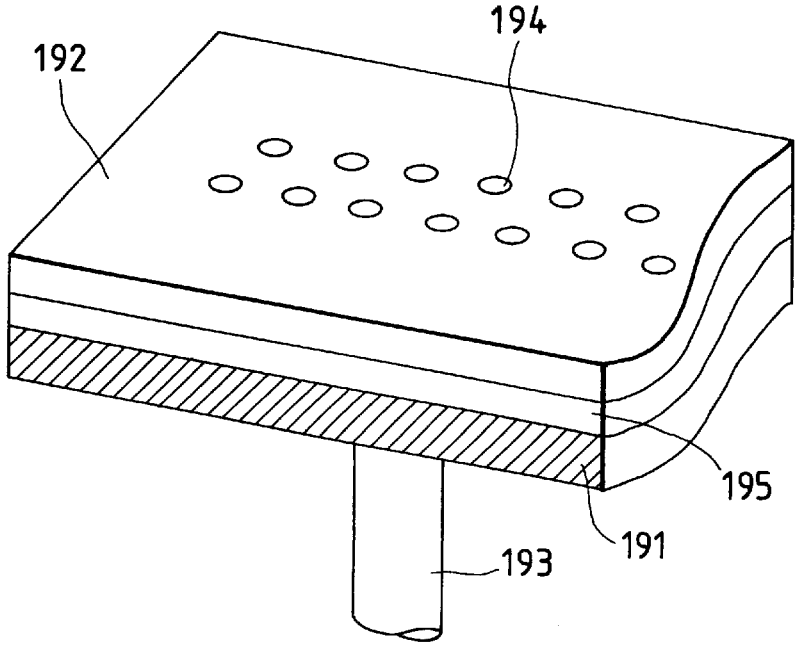
FIG. 8 is a perspective view which shows the structure of an edge shooter type ink jet head using the substrate in accordance with either one of the fourth embodiment or the sixth embodiment.

FIG. 8 is a perspective view which shows a top shooter type ink jet head which incorporates any of the substrates of the fourth to sixth embodiments shown in FIG. 4 to FIG. 6.

FIG. 8 shows a substrate 192 onto which a photosensitive resin is laminated. The substrate may be constructed according to any of the fourth to sixth embodiments. Flow path walls 195 are formed by means of photolithographic and etching technique. Thereafter, an orifice plate 192 provided with ink discharge orifices 194 is produced by means of electrocasting, and is adhesively bonded on a plate 195 in which flow path walls are formed. In this manner discharge ports, discharge nozzles, and a liquid chamber are formed at the same time. Lastly, an ink supply tube 193 is adhesively bonded to an ink supply port of the substrate 191.

Figure 9:
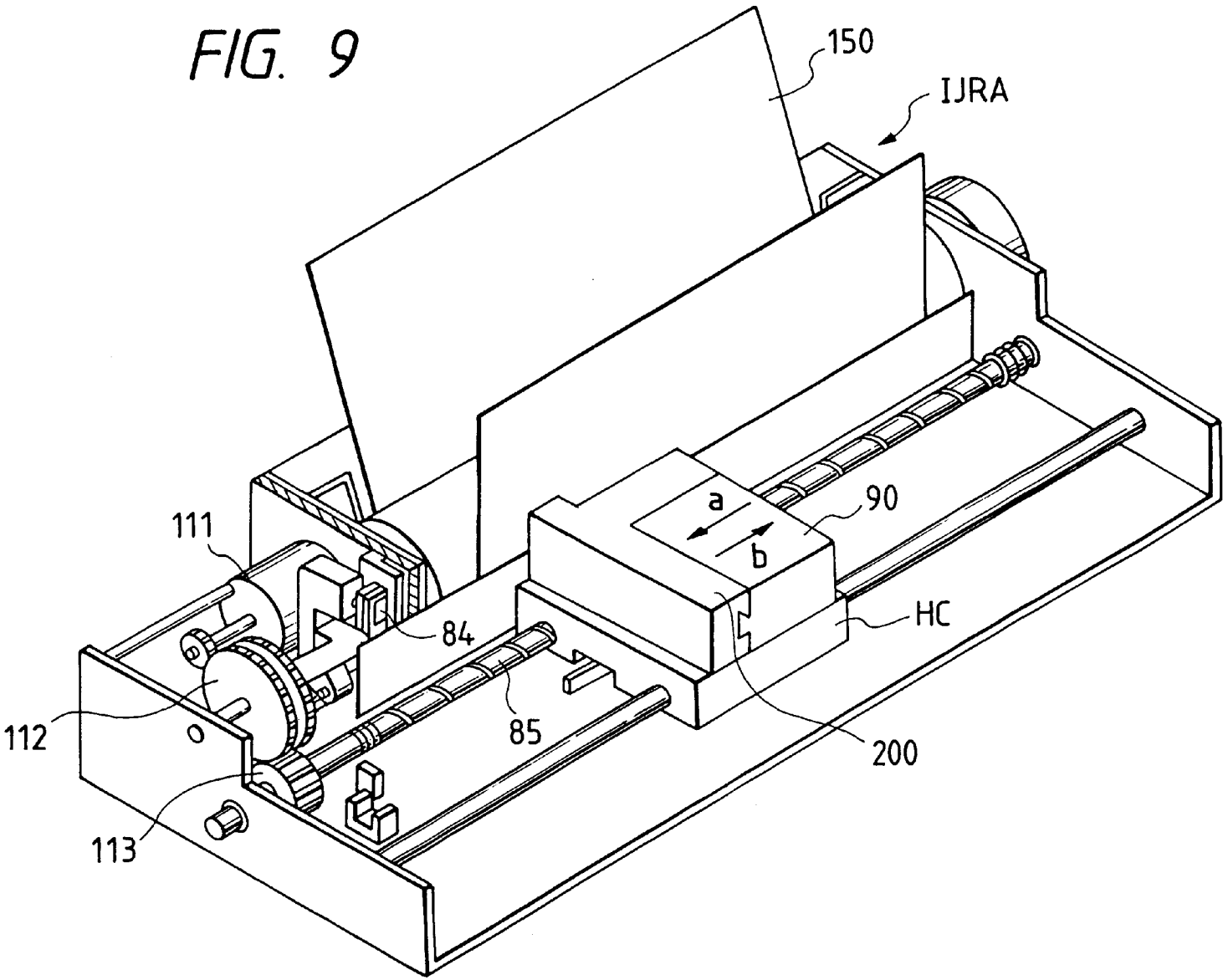
FIG. 9 is a structural view which schematically shows a liquid discharge apparatus.

FIG. 9 is a perspective view which schematically shows a recording apparatus 1JRA which incorporates a liquid discharge apparatus that mounts an ink jet head described above. As shown, a carriage HC that uses ink as discharging liquid, mounts the head cartridge has detachably mounted therein with a liquid ink containing tank 90 and a liquid ink discharge head. The carriage HC is mounted to reciprocate in the width direction of a recording medium, such as recording sheet 150 being carried by the recording apparatus.

When driving signals are supplied to the discharge head 200, ink is discharged from the head 200 and onto the recording medium 150.

The recording apparatus 1JRA is provided with a drive motor 111, gears 112 and 113, and a carriage drive shaft 85 to drive the carriage across the width of the recording medium 150. It is possible to record good images by discharging liquid onto many various kinds of recording media by use of the above described recording apparatus and liquid ink discharge head.

Figure 10:
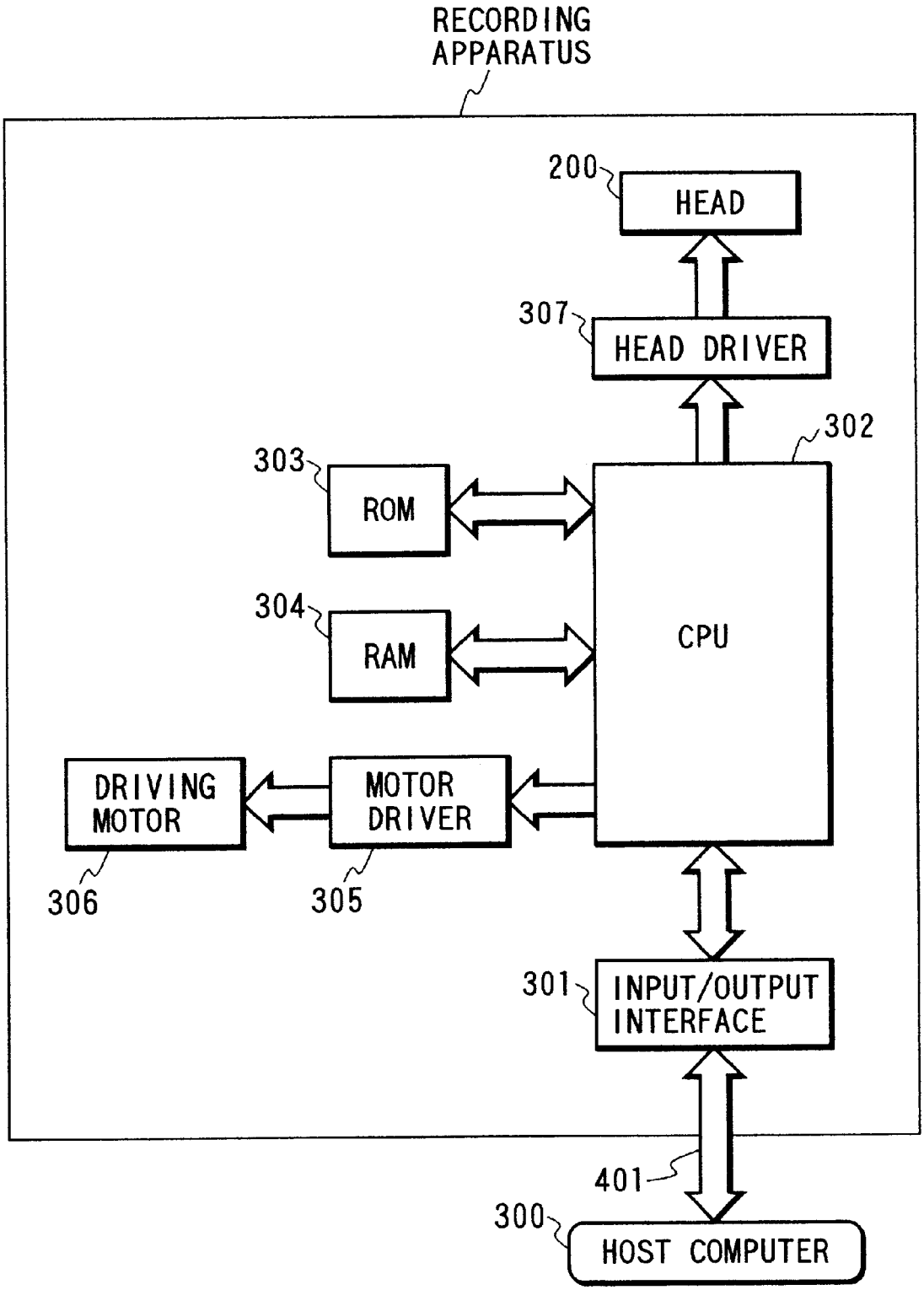
FIG. 10 is a block diagram which shows the apparatus represented in FIG. 9.

FIG. 10 is a block diagram which shows the arrangement of the components which comprise the recording apparatus of FIG. 9 and which discharges ink for recording by the method of the present invention.

This recording apparatus receives printing control signals via an interface line 401 from a host computer 300. Signals which contain printing information are temporarily stored in an input/output interface 301 in the recording apparatus. At the same time, the printing information signals are converted to a form in which they can be processed in the recording apparatus. The converted signals are then applied to a control processing unit (CPU) 302 that supplies driving signals via a head driver 307 to discharge heads 200. The CPU 302 processes signals received from the interface 301 data using peripheral units such as RAM 304 and others with control program signals stored in a read only memory (ROM) 303 and a random access memory (RAM) 304, and converts them to printing signals (image data).

The CPU 302 also supplies signals to a motor driver 305 which in turn controls a driving motor 306 that advances the recording sheet 150 (FIG. 9) and the recording head 200 in synchronism for depositing ink droplets in appropriate positions on the recording sheet 150. Signals representing image data and driving data are transferred to the recording head 200 and the driving motor 306 through the head driver 307 and the motor driver 305, respectively.

Various types of recording medium are usable with the recording apparatus described above. These include various types of paper and overhead projection (OHP) sheets, plastic materials used for compact disc, ornamental board, or the like, cloths, metallic materials such as aluminum and copper, cattle hide, pig hide, artificial leathers or other leather materials, wood, plywood, bamboo, tiles and other ceramic materials, sponge or other three-dimensional structures.

Also, various different recording apparatus corresponding to that described above, can be used for recording on various paper and OHP sheets, plastic media, compact discs, plastic materials, metallic plates, leathers, wood, ceramics, three-dimensional net structures such as sponge and textiles such as cloths.

Various kinds of liquid may be discharged with the above mentioned recording apparatuses, according to the kinds of recording media and recording conditions involved.

(Recording System)

The following is a description of one example of an ink jet recording system that uses a liquid discharge head according to the present invention to carry out recording on a recording medium.

Figure 11:
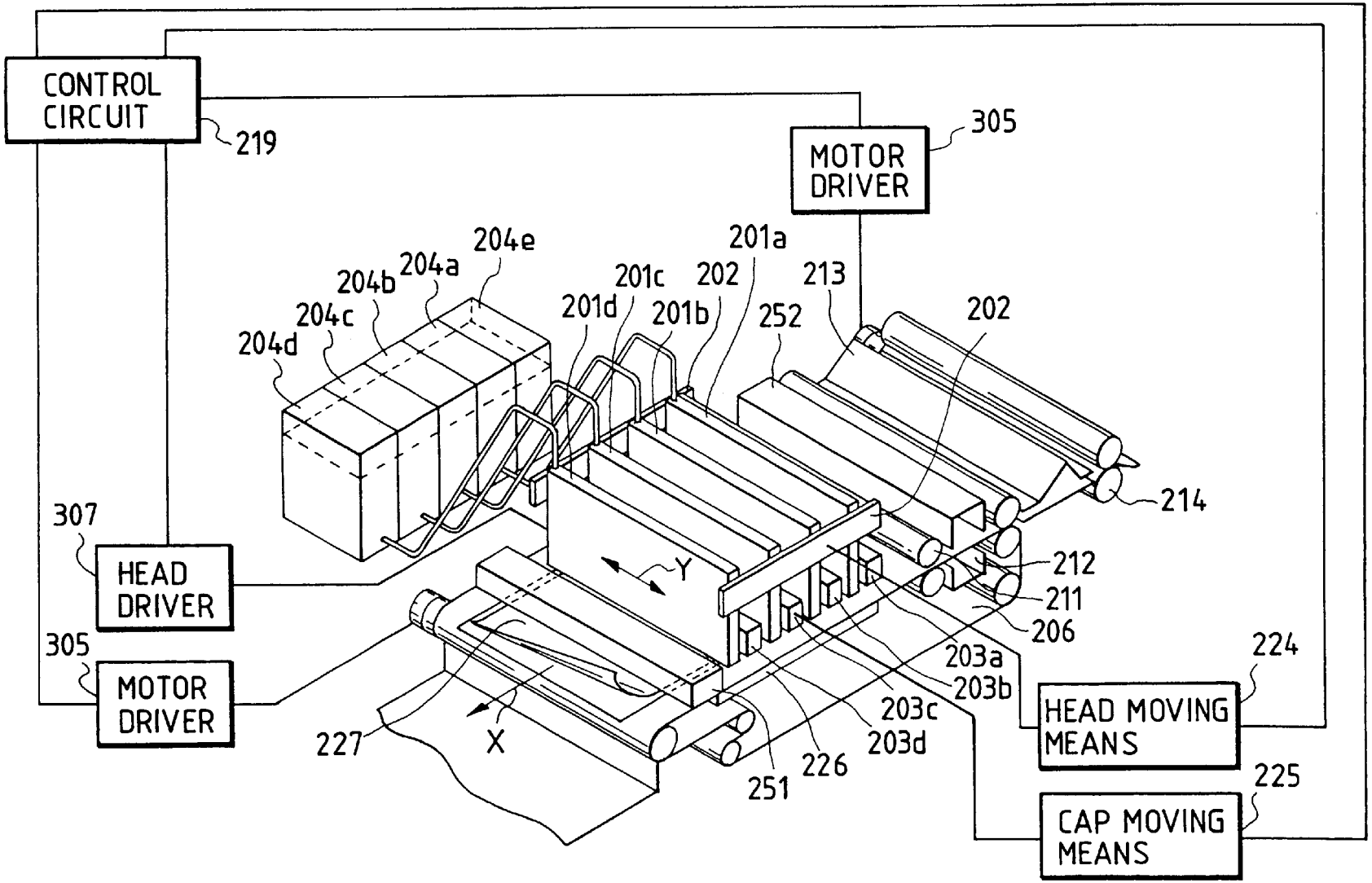
FIG. 11 is a view which shows a liquid discharge recording system.

FIG. 11 is a perspective view which schematically illustrates an ink jet recording system using a liquid discharge head 201*a*–201*d* of the present invention as described above. The liquid discharge head 201*a*–201*d* is a full line type head where a plurality of discharge ports are arranged along a direction that corresponds to the recordable width of a recording medium 227 at an interval density of 360 data per inch (dpi). Four liquid discharge heads 201*a*, 201*b*, 201*c*, and 201*d* are fixedly supported on a holder 202 in parallel and at given intervals in a direction X. These heads each discharge ink in a different one of four colors, namely yellow (Y), magenta (M), cyan (C), and black (Bk).

A head driver 307 provides driving signals which are supplied to each of the liquid discharge heads.

Four different colors of ink, Y, M, C, Bk, are supplied from ink containers 204*a* to 204*d*, respectively. A liquid ink container 204*e* is arranged to supply ink to each of the liquid discharge heads.

Liquid discharge head caps 203*a* to 203*d* are arranged below each of the discharge heads 204*a*–204*d*. These caps each have sponge or other ink absorbing material therein, which cover discharge ports of the liquid discharge heads in order to prevent discharge of ink during non-recording intervals.

A carrier belt 206 is configured to carry the particular type of recording medium, as described above which is to receive a recorded image. This carrier belt 206 is guided by various rollers to pass along the discharge heads 201*a*–201*d*. The belt 206 is driven by driving rollers which are coupled to a motor driver 305.

A pre-processing device 251, and a post-processing device 252 are installed upstream and downstream, respectively, of the discharge heads 201*a*–201*d* to perform various processing operations to the recording medium before and after recording.

Different pre-processing and post-processing operations are performed depending on the kinds of recording media and kinds of ink being used. For example, when recording on a medium such as metal, plastic, or ceramic, the recording medium is exposed to ultraviolet rays and ozone activate the surface of the medium which improves ink adhesion. Also, when recording media such as plastic tend to generate static which causes dust particles to be attracted to the surface of the medium, which often hinders good recording. To correct this situation the pre-processing device takes the form of an ionizer which removes static electricity. In this way, dust particles are eliminated from the recording medium. When cloth is used as a recording medium, a pre-processing operation may be performed whereby a substance such as an alkali, a water-soluble substance, a synthetic polymer, a water-soluble metallic salt, urea, or thiourea is applied to the cloths in order to prevent stains while improving its coloring rate. Pre-processing is not necessarily limited to those methods described above. Other methods may be used; for example the temperature of the recording medium may be adjusted appropriately to a temperature which is suited for recording on the particular medium.

The post-processing operation may involve a fixation process to promote the fixation of ink on the medium by use of heat or irradiation with ultraviolet rays, for example. A post-processing cleaning operation may also be carried out in order to rinse off the processing agent that had been applied to the recording medium in the pre-processing operation but is still retained on the medium.

The foregoing description has been made on the assumption that a full line head is used as the liquid discharge head. However, but the present invention is not necessarily limited to a full line head. It may be possible, for example, to apply the present invention to an arrangement in which a smaller liquid discharge head, such as described earlier, is transported in the width direction of a recording medium for recording on the medium.

As described above, in accordance with the present invention, the electric power wiring is divided into plural groups on and within the substrate; and these groups are arranged such that the resistive values are almost the same up to the pads for external fetching. In this way, it is possible to reduce the difference in voltage drop across the common electrodes when all the heat generating resistors are driven and when only one of them is driven.

Several groups of heat generating resistors, which may be driven at the same time, can be arranged in association with one heat generating resistor. This makes it possible to eliminate any difference in voltage drop when all the heat generating resistors are driven and when only one of them is driven. Then, with the reduction of the amount of simultaneous driving by use of the time divisional driving, it is possible to reduce the number of groups within the substrate, thus producing more favorable effect.

Further, by incorporating the driving element on the substrate, it becomes possible to arrange the electric power wiring more freely and this in turn facilitates both the grouping of the wires and the setting of resistive values.

Particularly, it is possible with the invention to reduce the number of fetching connections by grouping the electric power wiring within the substrate and by connecting the groups with the external fetching electrode pads.

Also, for ink jet heads that discharge ink vertically from heat generating resistors, the pads for external fetching may be arranged on the edge portions of the substrate perpendicular to the arrangement direction of the heat generating resistors. In this way, the pad area can be made smaller. This also provides more flexibility in the arrangement of the nozzle arrays.

In the cases described above, the electric power wiring can be arranged to decrease the size of substrate, which leads to significant reduction of costs of manufacture.

What is claimed is:

1. In a substrate for an ink jet recording head:

a plurality of heat generating resistors for discharging ink;

a group of electrode pads for receiving electrical power for said heat generating resistors, said electrode pads being located at different distances from their respective heat generating resistors; and a group of electrodes, each electrode being connected between a selected electrode pad and a set of associated heat generating resistors, said electrodes being configured and arranged such that each electrode presents the same electrical resistance between its associated electrode pad and its set of associated resistors.

2. A substrate for an ink jet recording head according to claim 1, wherein a driving element is incorporated within said substrate for driving heat generating resistors.

3. A substrate for an ink jet recording head according to either one of claims 1 or 2, wherein the said electrodes are connected to their respective electrode pads adjacent to said respective electrode pads.

4. A substrate for an ink jet recording head according to claim 1, wherein said electrode pads are arranged on an edge portion of said substrate which extends in an arrangement direction which is different from the arrangement direction of the corresponding plurality of heat generating resistors.

5. In a method for driving a substrate for an ink jet recording head which comprises:

a plurality of heat generating resistors for discharging ink;

a group of electrode pads for receiving electrical power of said heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and its set of associated resistors:

the step of performing time divisional driving for said heat generating resistors.

6. In an ink jet head, a substrate comprising:

a plurality of heat generating resistors for discharging ink;

a group of electrode pads for receiving electrical power for said heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors.

7. In a method for driving a substrate for an ink jet recording head which comprises:

a plurality of heat generating resistors for discharging ink;

a group of electrode pads for receiving electrical power for said heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors, said electrodes being connected to their respective electrode pads adjacent to said respective electrode pads;

the step of performing time divisional driving for said heat generating resistors.

8. In an ink jet head, a substrate having a plurality of heat generating resistors for discharging ink;

a group of electrode pads for receiving electrical power for said heat generating resistors, said electrode pads being located at different distances from their respective heat generating resistors;

a group of electrodes, each electrode being connected between a selected electrode pad and a set of associated heat generating resistors, said electrodes being configured and arranged such that each electrode presents the same electrical resistance between its associated electrode pad and its set of associated resistors; and a circuit for performing time divisional driving or said heat generating reistors.

9. In an ink jet cartridge, an ink jet head which includes a substrate having a plurality of heat generating resistors for discharging ink;

a group of electrode pads for receiving electrical power for said heat generating resistors, said electrode pads being located at different distances from their respective heat generating resistors; and a group of electrodes, each electrode being connected between a selected electrode pad and a set of associated heat generating resistors, said electrodes being configured and arranged such that each electrode presents the same electrical resistance between it s associated electrode pad and its set of associated resistors;

said ink jet head further including liquid flow passages which extend along said heat generating resistors; and a container retaining ink therein and arranged in fluid communication with said liquid flow passages.

10. A liquid discharge apparatus comprising:

an ink jet head which includes a substrate having a plurality of heat generating resistors for discharging ink;

a group of electrode pads for receiving electrical power for said heat generating resistors, said electrode pads being located at different distances from their respective heat generating resistors; and a group of electrodes, each electrode being connected between a selected electrode pad and a set of associated heat generating resistors, said electrodes being configured and arranged such that each electrode presents the same electrical resistance between its associated electrode pad and its set of associated resistors; and means mounted on said substrate and connected to said electrodes to supply driving signals for discharging liquid from said ink jet head.

11. In a method for driving a substrate for an ink jet recording head which comprises:

a plurality of heat generating resistors for discharging ink;

a group of electrode pads for receiving electrical power for said heat generating resistors, said electrode pads being located at different distances from their respective heat generating resistors;

a driving element incorporated within said substrate for driving said heat generating resistors;

a group of electrodes, each electrode being connected between a selected electrode pad and a set of associated heat generating resistors, said electrodes each being configured and arranged to present the same electrical resistance between its associated electrode pad and its set of associated resistors:

the step of performing time divisional driving for said heat generating resistors.

12. In a method for driving a substrate for an ink jet recording head which comprises:

a plurality of heat generating resistors for discharging ink;

a group of electrode pads for receiving electrical power for said heat generating resistors, said electrode pads being arranged on an edge portion of said substrate to provide an arrangement direction which is different from the arrangement direction of said plurality of heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors; and the step of performing time divisional driving for said heat generating resistors.

13. In an ink jet head, a substrate comprising:

a plurality of heat generating resistors for discharging ink;

a group of electrode pads for receiving electrical power for said heat generating resistors, said electrode pads being located at different distances from their respective heat generating resistors;

a driving element incorporated within said substrate for driving said heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors.

14. In an ink jet head, a substrate comprising:

a plurality of heat generating resistors for discharging ink;

a group of electrode pads for receiving electrical power for said heat generating resistors, said electrode pads being arranged on an edge portion of said substrate to provide an arrangement direction which is different from the arrangement direction of said plurality of heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors.

15. In an ink jet head, a substrate comprising:

a plurality of heat generating resistors for discharging ink;

a group of electrode pads for receiving electrical power for said heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors, said common wirings being connected to their respective electrode pads adjacent to said respective electrode pads.

16. An ink jet head according to one of claims 6, 13, 14 and 15, said ink jet head having liquid flow passages associated with each of said heat generating resistors and a container retaining ink therein, said container being connected to supply ink to said liquid flow passages.

17. An ink jet head according to one of claim 6, 14 and 15 wherein:

said substrate has mounted thereon means connected to said electrode to supply driving signals to said heat generating resistors for discharging liquid from said ink jet head.

18. In a method for driving a substrate for an ink jet recording head which comprises:

a plurality of heat generating resistors for discharging ink;

a group of electrode pads for receiving electrical power of said heat generating resistors, said electrode pads being located at different distances from their respective heat generating resistors;

a driving element incorporated within said substrate for driving heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors:

the step of performing time divisional driving for said heat generating resistors.

19. A method for driving a substrate for an ink jet recording head according to one of claims 7 and 18, wherein said time divisional driving is performed by driving different groups of said heat generating resistors at different times.

20. In a method for driving a substrate for an ink jet recording head which comprises:

a plurality of heat generating resistors for discharging ink;

a group of electrode pads for receiving electrical power of said heat generating resistors, said electrode pads being located at different distances from their respective heat generating resistors; and a group of electrodes, each electrode being connected between a selected electrode pad and a set of associated heat generating resistors, said electrodes each being configured and arranged to present the same electrical resistance between its associated electrode pad and each of said set of associated resistors, the common wirings being connected to their respective electrode pads adjacent to said respective electrode pads:

the step of performing time divisional driving for said heat generating resistors.

21. A method for driving a substrate for an ink jet recording head according to claim 5, 7, 11 or 12 wherein said time divisional driving is performed by driving different ones of said groups at different times.

* * * * *

UNITED STATES PATENT AND TRADEMARK OFFICE

CERTIFICATE OF CORRECTION

PATENT NO. : 6,409,315 B2
DATED : June 25, 2002
INVENTOR(S) : Hirokazu Komuro

It is certified that error appears in the above-identified patent and that said Letters Patent is hereby corrected as shown below:

Title page, Item [54] and Column 1, line 4,
Title, "AND AN JET" should read -- AND AN INK JET --.
Item [56], FOREIGN PATENT DOCUMENTS,
"54051837" should read -- 54-051837 --;
"57072867" should read -- 57-072867 --; and
"62013367" should read -- 62-013367 --.

Column 1,
Line 48, "electrodes" should read -- electrode --.

Column 3,
Line 54, "increases" should read -- increase --.

Column 4,
Line 66, "of" should read -- of the --.

Column 11,
Lines 37 and 48, "technique." should read -- techniques. --; and
Line 59, "has" should read -- and has --.

Column 13,
Line 27, "activate" should read -- to activate --.

Column 14,
Line 44, "the" should be deleted.

Column 15,
Line 45, "reistors." should read -- resistors. --; and
Line 57, "it s" should read -- its --.

UNITED STATES PATENT AND TRADEMARK OFFICE

CERTIFICATE OF CORRECTION

PATENT NO. : 6,409,315 B2
DATED : June 25, 2002
INVENTOR(S) : Hirokazu Komuro

It is certified that error appears in the above-identified patent and that said Letters Patent is hereby corrected as shown below:

Column 16,
Line 4, “resistors; and” should read -- resistors; --; and
Line 24, “resistors;” should read -- resistors; and --.

Signed and Sealed this

Seventh Day of January, 2003

JAMES E. ROGAN
*Director of the United States Patent and Trademark Office*